US011035028B2

(12) United States Patent
Söderberg et al.

(10) Patent No.: US 11,035,028 B2
(45) Date of Patent: *Jun. 15, 2021

(54) POWDER AND A HIP:ED OBJECT AND THE MANUFACTURE THEREOF

(71) Applicant: SANDVIK INTELLECTUAL PROPERTY AB, Sandviken (SE)

(72) Inventors: Hans Söderberg, Sandviken (SE); Thomas Blomfeldt, Sandviken (SE); Ulf Kivisäkk, Sandviken (SE); Lars-Olov Nordberg, Sandviken (SE); Zhiliang Zhou, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 16/495,609

(22) PCT Filed: Mar. 21, 2018

(86) PCT No.: PCT/EP2018/057221

§ 371 (c)(1),
(2) Date: Sep. 19, 2019

(87) PCT Pub. No.: WO2018/172437

PCT Pub. Date: Sep. 27, 2018

(65) Prior Publication Data

US 2020/0024711 A1 Jan. 23, 2020

(30) Foreign Application Priority Data

Mar. 22, 2017 (EP) ..... 17162456

(51) Int. Cl.

| | |
|---|---|
| ***C22C 30/02*** | (2006.01) |
| ***C22C 19/05*** | (2006.01) |
| ***C22C 38/44*** | (2006.01) |
| ***C22C 38/42*** | (2006.01) |
| ***C22C 33/02*** | (2006.01) |
| ***C22C 38/00*** | (2006.01) |
| ***C22C 38/02*** | (2006.01) |
| ***C22C 38/58*** | (2006.01) |
| ***C22C 38/60*** | (2006.01) |

(52) U.S. Cl.

CPC ..... *C22C 38/42* (2013.01); *C22C 19/055* (2013.01); *C22C 30/02* (2013.01); *C22C 33/0285* (2013.01); *C22C 38/001* (2013.01); *C22C 38/02* (2013.01); *C22C 38/44* (2013.01); *C22C 38/58* (2013.01); *C22C 38/60* (2013.01)

(58) Field of Classification Search

None

See application file for complete search history.

(56) References Cited

U.S. PATENT DOCUMENTS

| | | | | |
|---|---|---|---|---|
| 5,858,129 | A | 1/1999 | Kobayashi et al. | |
| 7,081,173 | B2 | 7/2006 | Bahar et al. | |
| 9,228,250 | B2 | 1/2016 | Alves et al. | |
| 2014/0083576 | A1* | 3/2014 | Sawawatari | C22C 38/02 148/707 |
| 2017/0021423 | A1 | 1/2017 | Berglund et al. | |

FOREIGN PATENT DOCUMENTS

| | | | |
|---|---|---|---|
| JP | H01-111841 | A | 4/1989 |
| JP | H06-306553 | A | 11/1994 |
| JP | 2005-509751 | A | 4/2005 |
| JP | 2014-500907 | A | 1/2014 |

OTHER PUBLICATIONS

Translation of JP 06-306553-A (originally published Nov. 1, 1994) from J-Plat Pat.*

Office Action issued in corresponding Japanese Patent Application No. 2019-551348, dated Feb. 4, 2020.

International Search Report and Written Opinion dated Jun. 6, 2018, issued in corresponding International Patent Application No. PCT/EP2018/057221.

* cited by examiner

*Primary Examiner* — George Wyszomierski

(74) *Attorney, Agent, or Firm* — Morgan, Lewis & Bockius LLP

(57) ABSTRACT

The present disclosure relates to a powder of an austenitic alloy and a HIP:ed object manufactured thereof and a process for the manufacturing the HIP:ed object and its use in corrosive environments.

30 Claims, No Drawings

POWDER AND A HIP:ED OBJECT AND THE MANUFACTURE THEREOF

TECHNICAL FIELD

The present disclosure relates to a powder of an austenitic alloy and a HIP:ed object manufactured thereof and a process for the manufacturing the HIP:ed object and its use in corrosive environments.

BACKGROUND

Components manufactured from duplex stainless steels are usually used in oil and gas applications, especially in subsea environment because of their high yield strength and generally good corrosion resistance. One problem, however, with duplex stainless steels is that these steels may be prone to hydrogen induced stress cracking (HISC). Components manufactured from austenitic alloys are also used but these alloys may have too low yield strength even though they are known to not be affected by HISC. Also, components manufactured from a precipitation hardened Ni-base alloy may be used but these alloys may be prone to hydrogen embrittlement.

Thus, there is a need for an object (a component) comprising an alloy which is not affected by HISC and which has high yield strength and which is resistant against hydrogen embrittlement. The aspect of the present disclosure is therefore to solve or at least reduced the above-mentioned problems.

SUMMERY

The present disclosure provides a powder of an austenitic alloy, wherein said powder has the following composition in weight % (wt %):

C less than or equal to 0.03;
Si less than or equal to 0.5;
Mn less than or equal to 2.0;
P less than or equal to 0.01;
S less than or equal to 0.05;
Cr 25 to 28;
Ni 33 to 36;
Mo 6 to 7.5;
N 0.20 to 0.60;
Cu less than or equal to 0.4;
balance Fe and unavoidable impurities.

The present disclosure also relates to a HIP:ed object manufactured from a powder having the following composition in weight %:

C less than or equal to 0.03;
Si less than or equal to 0.5;
Mn less than or equal to 2.0;
P less than or equal to 0.01;
S less than or equal to 0.05;
Cr 25 to 28;
Ni 33 to 36;
Mo 6 to 7.5;
N 0.20 to 0.60;
Cu less than or equal to 0.4;
balance Fe and unavoidable impurities.

Hence, the present disclosure relates to a HIP:ed object comprising an austenitic alloy comprising the same element in the same ranges as the powder as defined hereinabove or hereinafter. In addition to contain the austenitic alloy, the obtained HIP:ed object will be isotropic in regard to the distribution and to the shape of the phases (i.e. the microstructure) meaning that the HIP:ed object will have resistance against HISC and also have the same mechanical strength in all directions.

The present disclosure further relates to a method of manufacturing a HIP:ed object comprising the steps of:

a) providing a form defining at least a portion of the shape of said object;
b) providing a powder as defined hereinabove or hereinafter;
c) filling at least a portion of said form with said powder;
d) subjecting said form to hot isostatic pressing at a predetermined temperature, a predetermined isostatic pressure and for a predetermined time so that the powder particles bond metallurgically to each other.

DETAILED DESCRIPTION

As stated above, the present disclosure relates to a powder having the following composition in weight % (wt %):

C less than or equal to 0.03;
Si less than or equal to 0.5;
Mn less than or equal to 2.0;
P less than or equal to 0.01;
S less than or equal to 0.05;
Cr 25 to 28;
Ni 33 to 36;
Mo 6 to 7.5;
N 0.20 to 0.60;
Cu less than or equal to 0.4;
balance Fe and unavoidable impurities.

The present disclosure also relates to a HIP:ed object manufactured from a powder having the following composition in weight % (wt %):

C less than or equal to 0.03;
Si less than or equal to 0.5;
Mn less than or equal to 2.0;
P less than or equal to 0.01;
S less than or equal to 0.05;
Cr 25 to 28;
Ni 33 to 36;
Mo 6 to 7.5;
N 0.20 to 0.60;
Cu less than or equal to 0.4;
balance Fe and unavoidable impurities.

Hence, the present disclosure relates to a HIP:ed object comprising an austenitic alloy having the following composition in weight % (wt %):

C less than or equal to 0.03;
Si less than or equal to 0.5;
Mn less than or equal to 2.0;
P less than or equal to 0.01;
S less than or equal to 0.05;
Cr 25 to 28;
Ni 33 to 36;
Mo 6 to 7.5;
N 0.20 to 0.60;
Cu less than or equal to 0.4;
balance Fe and unavoidable impurities.

Alternatively, the HIP:ed object may be a hollow or a billet or a bar which may then be worked to a tube or a pipe by hot working, such as extrusion.

The present disclosure also relates to a method of manufacturing a HIP:ed object comprising the steps of:

a) providing a form defining at least a portion of the shape of said object;
b) providing a powder as defined hereinabove or hereinafter;

c) filling at least a portion of said form with said powder;

d) subjecting said form to hot isostatic pressing at a predetermined temperature, a predetermined isostatic pressure and for a predetermined time so that the powder particles bond metallurgically to each other.

According to one embodiment of the present disclosure, the obtained HIP:ed object will be heat treated, such as by solution annealing, in order to increase the strength of the HIP:ed object.

The present disclosure also relates to a method of manufacturing a HIP:ed object, wherein the object is a tube comprising the steps of:

a) providing a form defining a shape of a billet or a hollow or a bar;

b) providing a powder as defined hereinabove or hereinafter;

c) filling at least a portion of said form with said powder;

d) subjecting said form to hot isostatic pressing at a predetermined temperature, a predetermined isostatic pressure and for a predetermined time so that the powder particles bond metallurgically to each other;

e) hot working the obtained billet, hollow or the bar.

According to one embodiment, the hot working process is extrusion. Examples of other hot working processes are hot rolling and hot piercing. A hot working step may optionally comprise one or more hot working processes.

According to another embodiment, the method comprises a cold working step which may be performed after the hot working step. Examples of, but not limited to, cold working processes are cold rolling, cold drawing, cold pilgering and straightening. A cold working step may comprise one or more cold working processes. Also, the cold working processes may be the same or different.

According to another embodiment, the method may comprise a heat treatment step which is performed after the hot working step or after the cold working step. Example of, but not limited to, a heat treatment process is annealing, such as solution annealing.

Hot Isostatic Pressing (HIP) is a technique known in the art. As the skilled person is aware, for alloys to be subjected to hot isostatic pressing, they should be provided in the form of a powder. Such powder can be obtained by atomizing a hot alloy, i.e. by spraying the hot alloy through a nozzle whilst in a liquid state (thus forcing molten alloy through an orifice) and allowing the alloy to solidify immediately thereafter.

Atomization is conducted at a pressure known to the skilled person as the pressure will depend on the equipment used for performing atomization. According to one embodiment, the technique of gas atomization is employed, wherein a gas is introduced into the hot metal alloy stream just before it leaves the nozzle, serving to create turbulence as the entrained gas expands (due to heating) and exits into a large collection volume exterior to the orifice. The collection volume is preferably filled with gas to promote further turbulence of the molten metal jet.

D50 of the size distribution of the particles is usually of from 80-130 μm. The resulting powder is then transferred to a mold.

According to the method as defined hereinabove or hereinafter, a form, also referred to as a mould or a capsule, is provided. The form defined as least a portion of the shape or contour of the object to be obtained. The form is typically manufactured from steel sheets which are welded together. The form is removed after HIP by for example pickling or machining.

At least part of the form is filled but it will depend on whether or not the entire object is made in a single HIP step. The mould is subjected to Hot Isostatic Pressing (HIP) so that the particles of said powder bond metallurgically to each other. According to one embodiment, the mold is fully filled and the object is made in a single HIP step.

The HIP method is performed at a predetermined temperature, below the melting point of the austenitic alloy, preferably in the range of from 1000-1200° C. The predetermined isostatic pressure is >900 bar, such as about 1000 bar and the predetermined time is in the range of from 1-5 hours. After the HIP process, the object is removed from the mold. Usually this is performed by removing the mold itself, e.g. by machining or pickling. The form of the object obtained is determined by the form of the mold and the degree of filling.

The HIP method may also be followed by a heat treatment, such as solution annealing, meaning that the obtained object is heat-treated at a temperature ranging of from 1000-1300° C., such as 1100 to 1200° C., for 1-5 h with subsequent quenching.

Hereinafter, the alloying elements of the austenitic alloy as defined hereinabove or hereinafter are discussed regarding their effect. However, this should not be interpreting as limiting. The elements may also have other effects not mentioned. The terms "weight %" or "wt. %" are used interchangeably.

Carbon (C): less than or equal to 0.03 wt. %

C is an impurity contained in the austenitic alloy. When the content of C exceeds 0.03 wt. %, the corrosion resistance is reduced due to the precipitation of chromium carbide in the grain boundaries. Thus, the content of C is less than or equal to 0.03 wt. %, such as less than or equal to 0.02 wt. %.

Silicon (Si): less than or equal to 0.5 wt. %

Si is an element which may be added for deoxidization. However, Si will promote the precipitation of the intermetallic phases, such as the sigma phase, therefore Si is contained in a content of equal to or less than 0.5 wt. %, such as 0.1 to 0.5 wt. %.

Manganese (Mn): less than or equal to 2.0 wt. %

Mn is used in most stainless alloys because Mn has the ability to bind sulphur, which is an impurity and by binding sulphur, the hot ductility is favorable. At levels, above 2.0 wt. % Mn will reduce the mechanical properties. Thus, the content of Mn is less than or equal to 2.0 wt. %, such as less than 1.1 wt. %, such as 0.1 to 1.1 wt. %

Nickel (Ni): 33 to 36 wt. %

Ni is an austenite stabilizing element and is together with Cr and Mo beneficial for reducing stress corrosion cracking in stainless alloys. In order to achieve structure stability and thereby corrosion resistance, the content of Ni is required to be more than or equal to 33 wt. %. However, an increased Ni content will decrease the solubility of N. Therefore, the maximum content of Ni is less than or equal to 36 wt. %. According to one embodiment, the content of Ni is of from 34 to 36 wt. %.

Chromium (Cr): 25 to 28 wt. %

Cr is the most important element in stainless alloys as Cr is essential for creating the passive film, which will protect the stainless alloy from corroding. Also, the addition of Cr will increase the solubility of N. When the content of Cr is less than 25 wt. %, the corrosion resistance for the present austenitic alloy will not be sufficient, and when the content of Cr is more than 28 wt. %, secondary phases, such as nitrides and sigma phase will be formed, which will adversely affecting the corrosion resistance. Accordingly, the content of Cr is therefore of from 25 to 28 wt. %, such as of from 26 to 28 wt. %.

Molybdenum (Mo): 6.0 to 7.5 wt. %

Mo is effective in stabilizing the passive film formed on the surface of the austenitic alloy and is also effective in improving the pitting resistance. When the content of Mo is less than 6.0 wt. %, the corrosion resistance against pitting is not high enough for the austenitic alloy as defined hereinabove or hereinafter. However, a too high content of Mo will promote the precipitation of intermetallic phases, such as sigma phase and also deteriorate the hot workability. Accordingly, the content of Mo is of from 6.0 to 7.5 wt. %, such as 6.1 to 7.1 wt. %, such as of from 6.1 to 6.7 wt. %.

Nitrogen (N): 0.25 to 0.6 wt. %

N is an effective element for increasing the strength of an austenitic alloy, especially when heat treatment, such as solution hardening, is used in the manufacturing process. N is also beneficial for the structure stability. Furthermore, N will improve the deformation hardening during cold working. When the content of N is less than 0.25 wt. %, the austenitic alloy as defined hereinabove or hereinafter will not have high enough strength. If the content of N is more than 0.6 wt. %, it will not be possible to dissolve further N in the alloy. According to one embodiment, the amount of N is from such as 0.25 to 0.40 wt. %, such as 0.30 to 0.38 wt. %.

Phosphorus (P): less than or equal to 0.05 wt. %

P is an impurity contained in the austenitic alloys and it is well known that P affects the hot workability negatively. Accordingly, the content of P is set at 0.05 wt. % or less such as 0.03 wt. % or less, such as 0.010 wt. %.

Sulphur (S): less than or equal to 0.05 wt. %

S is an impurity contained in the austenitic alloys and it will deteriorate the hot workability. Accordingly, the allowable content of S is less than or equal to 0.05 wt. %, such as less than or equal to 0.02 wt. %, such as 0.005 wt %.

Copper (Cu): less than or equal to 0.4 wt. %

Cu is an optional element and will above 0.4 wt. % affect the mechanical properties negatively. According to one embodiment, the content of Cu is less than or equal to 0.3 wt. %, such as less than or equal to 0.25 wt. %.

Oxygen (O): less than or equal to 200 ppm

O is an element which may be present in the austenitic alloy even though it is not added purposively. The aim is to avoid oxygen as it will influence the impact strength negatively. At levels higher than 200 ppm, the impact strength of the HIP:ed object will be too low, thus the object cannot be used in any applications.

The term "impurities" as referred to herein is intended to mean substances that will contaminate the austenitic alloy when it is industrially produced, due to the raw materials such as ores and scraps, and due to various other factors in the production process, and are allowed to contaminate within the ranges not adversely affecting the austenitic alloys as defined hereinabove or hereinafter. According to one embodiment, the alloy as defined hereinabove or hereinafter consists of the elements in the ranges mentioned herein. Further, the terms "max" or "less than", mean that the lowest value of the range is "0".

The added benefit of the present disclosure will be particularly useful when the obtained HIP:ed objects are to be used in a highly corrosive environment. Examples of, but not limited to, particular highly corrosive environments are subsea structures used for collecting oil and gas, as they are exposed to seawater at the outside and well stream at the inside, and also those environments present in the petrochemical industry and chemical industry.

The present disclosure relates to the use of a HIP:ed object according to the invention as described hereinabove or hereinafter, or as produced by a method as described hereinabove or hereinafter, as a construction material for a component for example in the petrochemical industry, the chemical industry, as a subsea structure, such as HUB:s or manifolds. According to one embodiment, one embodiment of such object is a welded tube (constructional object) comprising of two or more tubes which comprises the powder as defined hereinabove or hereinafter and has been manufactured according to the methods as defined hereinabove or hereinafter. The two or more tubes are connected to each other at the end of each tube by welding. The tubes have either been hot worked or cold worked and then heat treated before the joining is performed. The skilled person will consider also other technical field where the present HIP:ed object will be useful in as a component.

Alternatively, according to one embodiment, the obtained HIP:ed object is a block (or any other indifferent shape), upon which the desired final component can be made by employing various machining techniques, such as turning, threading, drilling, sawing and milling, or a combination thereof, such as milling or sawing followed by turning.

The disclosure is further illustrated by the following non-limiting examples.

EXAMPLES

Example 1

Five heats were manufactured accordingly: atomization of 150 kg heats of virgin raw material. For three heats, the material for the atomization was obtained from HF-heats. How the atomization is performed does not affect the properties of the final object. The obtained powder was filled in capsules and hot isostatically pressed at 1150° C. at 100 MPa for 3 hours. The capsules were slowly cooled and heat treated at 1200° C. for 30 min followed by water quenching. The chemical compositions are shown in Table 1. In the table, some heats have been made in more than one sample. As the skilled person knows, when HIP is used as a manufacturing process, the content of O and N may differ for the same heat when it has been manufactured in different batches. Tensile specimens were obtained from the heat-treated material and the grain size was measured according to ASTM E112.

The mechanical properties were evaluated and as can be seen from Table 2, high yield strengths were obtained. The yield strengths for the HIP:ed material were higher compared to conventional material with similar composition.

TABLE 1

| Route | Heat | Lot | C | Si | Mn | P | S | Cr | Ni | Mo | N | Cu | W | O |
|---|---|---|---|---|---|---|---|---|---|---|---|---|---|---|
| HIP | 890182 | 1 | 0.008 | 0.22 | 1.04 | 0.005 | 0.0023 | 27.0 | 34.9 | 6.6 | 0.35 | 0.20 | <0.01 | 0.204 |
| HIP | 890183 | 1 | 0.012 | 0.22 | 1.06 | 0.004 | 0.0029 | 27.1 | 35.0 | 6.6 | 0.32 | 0.20 | <0.01 | 0.150 |
| HIP | 890273 | 1 | 0.007 | 0.23 | 1.07 | 0.005 | 0.0034 | 27.3 | 35.3 | 6.5 | 0.28 | 0.19 | <0.01 | 0.355 |

TABLE 1-continued

| Route | Heat | Lot | C | Si | Mn | P | S | Cr | Ni | Mo | N | Cu | W | O |
|---|---|---|---|---|---|---|---|---|---|---|---|---|---|---|
| HIP | 890273 | 2 | 0.007 | 0.23 | 1.07 | 0.005 | 0.0034 | 27.3 | 35.3 | 6.5 | 0.27 | 0.19 | <0.01 | 0.274 |
| HIP | 890274 | 1 | 0.011 | 0.21 | 1.04 | 0.006 | 0.0031 | 27.8 | 35.2 | 6.4 | 0.36 | 0.19 | <0.01 | 0.155 |
| HIP | 890274 | 2 | 0.011 | 0.21 | 1.04 | 0.006 | 0.0031 | 27.8 | 35.2 | 6.4 | 0.35 | 0.19 | <0.01 | 0.096 |
| HIP | 890275 | 1 | 0.012 | 0.24 | 1.05 | 0.006 | 0.0028 | 26.7 | 35.0 | 6.4 | 0.25 | 0.20 | 0.01 | 0.155 |

Fe and unavoidable impurities is the balance in each heat

TABLE 2

| Heat | Sample | Production route | Grain size [ASTM] | $Rp_{0.2}$ [MPa] | Rm [MPa] | A [%] | Impact strength at −46° C. [J] |
|---|---|---|---|---|---|---|---|
| 890182 | 1 | HIP | 8 | 503 | 911 | 46 | 84 |
| 890183 | 1 | HIP | 8 | 490 | 901 | 45 | 102 |
| 890273 | 1 | HIP | 7 | 475 | 884 | 44 | 98 |
| 890273 | 2 | HIP | 8 to 9 | 489 | 886 | 42 | 69 |
| 890274 | 1 | HIP | 6 | 494 | 911 | 49 | 152 |
| 890274 | 2 | HIP | 8 to 9 | 527 | 932 | 47 | 154 |
| 890275 | 1 | HIP | 6 | 437 | 847 | 49 | 160 |

In certain applications, it is desirable obtain a 65 ksi material (448 MPa), as can be seen from table 1 and table 2, in those application, the nitrogen content shall be above 0.25%. Further, in certain applications, it is desirable to have an impact strength at −46° C. above 100 J, in those applications, the oxygen content should be below 200 ppm.

Example 2

The powder was atomized from ingots produced in a 270 kg HF-furnace and then a capsule was filled and HIP:ed at 1150° C. at 100 MPa for 3 hours and solution annealed at about 1200° C., the material used were heat 890273 Sample 2 and heat 890274 Sample 2. The capsule size was 140×850 mm. The capsules were removed and the bar was machined to bar with a diameter of 130 mm. From the bar, samples for the evaluation of properties of the HIP condition were taken. These samples were solution annealed (heat treated) at 1150° C. with 10 minutes holding time and then water quenched.

The obtained extrusion billets were produced with the dimension outer diameter of 121 mm and wall thickness of 32 mm. The billets were then extruded at 1200° C. to tubes with dimension outer diameter of 64 mm and wall thickness of 7 mm. Tensile specimens were obtained from the solution annealed bar and the extruded tube and the grain size was measured according to ASTM E112.

As can be seen from Table 3, surprisingly high yield strength and good elongation were observed for the extruded tube in non-cold worked or non-precipitation hardened condition. As can be seen from Table 3, surprisingly high yield strength was present already without any further cold working after extrusion.

TABLE 3

| | | As HIP:ed OD 140 mm | | | | Extruded tube OD 63 × 7 mm | | | |
|---|---|---|---|---|---|---|---|---|---|
| Heat | Sample | $Rp_{0.2}$ [MPa] | Rm [MPa] | A [%] | Grain size [ASTM] | $Rp_{0.2}$ [MPa] | Rm [MPa] | A [%] | Grain size [ASTM] |
| 890273 | 2 | 489 | 886 | 42 | 8 to 9 | 445 | 826 | 53 | 8 |
| 890274 | 2 | 527 | 932 | 47 | 8 to 9 | 514 | 886 | 53 | 8 |

Example 3

A powder having the composition according to Table 4 was atomized from ingots produced in a 270 kg HF-furnace. A capsule was then filled and HIP:ed at 1150° C. at 100 MPa for 3 hours and then solution annealed at a temperature of 1200° C. The capsule size was 140×850 mm. The obtained extrusion billets were produced with the dimension outer diameter of 121 mm and wall thickness of 32 mm. The capsule was removed. The billets were then extruded at 1200° C. to tubes with dimension outer diameter of 64 mm and wall thickness of 7 mm. After pickling, the tubes were cold pilgered to 25.4×2.11 mm at room temperature and then solution annealed at a temperature of 1200° C.

A V-type joint with 65° bevel, 1.2 mm gap and 1.0 mm land was used for the filler material. Welding was performed at 1G welding position with tube rotation by manual gas tungsten arc welding (GTAW) process using a gas consisting of argon and 2 to 5% $N_2$ as shielding gas and root gas.

Tensile specimens were taken transverse to the tube welds and prepared in accordance with ASME IX QW-462.1(C). Two specimens from the tube were extracted longitudinal to the tube rolling direction as reference. Tensile test was carried at room temperature in accordance with ASTM E8M. CPT was performed according to modified ASTM G150 with 3 M $MgCl_2$.

As can be seen from the results, the cold pilgered and annealed tubes have an extreme high yield, 533 MPa yield strength when welded. The high yield strength together with high pitting resistance and good resistance to $H_2S$ makes such as combination of tubes and filler a very good choice for umbilical

TABLE 4

Chemical composition of the tube and for the used fillers.

| | C | Si | Mn | P | S | Cr | Ni | Mo | N | Cu | W | Fe | Co |
|---|---|---|---|---|---|---|---|---|---|---|---|---|---|
| Alloy according the present disclosure | 0.011 | 0.21 | 1.04 | 0.006 | 0.0031 | 27.8 | 35.2 | 6.4 | 0.35 | 0.19 | <0.01 | balance | |
| Filler (UNS N06022) | max 0.015 | max 0.08 | max 0.5 | max 0.02 | max 0.02 | 20-22.5 | balance | 12.5-14.5 | | | 2.5-3.5 | 2-6 | Max 2.5 |

TABLE 5

Mechanical properties for tube and welded joints.

| | Shielding gas | $R_{p0.2}$ (MPa) | $R_m$ (MPa) | A50 mm (%) |
|---|---|---|---|---|
| Tube | — | 529 | 919 | 44.4 |
| Tube welded with UNSN06022 | Ar + 4% $N_2$ | 533 | 845 | 21.4 |

The invention claimed is:

1. A powder, comprising an austenitic alloy having the following composition in weight %:

C less than or equal to 0.03;
Si 0.1 to 0.5;
Mn 0.1 to 2.0;
P less than or equal to 0.04;
S less than or equal to 0.05;
Cr 26.7 to 28;
Ni 35 to 36;
Mo 6.1 to 6.7;
N 0.32 to 0.60;
Cu less than or equal to 0.4;
balance Fe and unavoidable impurities.

2. The powder according to claim 1, wherein the content of Si is between 0.1 to 0.3 weight %.

3. The powder according to claim 1, wherein the content of Mn is from 0.1 to 1.1 weight.

4. The powder according to claim 1, wherein the content of Ni is from 35.3 to 36 weight %.

5. The powder according to claim 1, wherein the content of Mo is from 6.4 to 6.6 weight %.

6. The powder according to claim 1, wherein the content of N is of from 0.35 to 0.60 weight %.

7. The powder according to claim 1, wherein said powder comprises less than or equal to 200 ppm O.

8. The powder according to claim 1, wherein the content of Cr is from 26.7 to 27.8 weight %.

9. The powder according to claim 1, wherein the content of N is of from 0.32 to 0.38 weight %.

10. The powder according to claim 1, comprising an austenitic alloy having the following composition in weight %:

C less than or equal to 0.03;
Si 0.1 to 0.3;
Mn 0.1 to 0.5;
P less than or equal to 0.04;
S less than or equal to 0.05;
Cr 26.7 to 27.8;
Ni 35.3 to 36;
Mo 6.4 to 6.7;
N 0.35 to 0.60;
Cu less than or equal to 0.4;
O less than or equal to 200 ppm;
balance Fe and unavoidable impurities.

11. A method of manufacturing a HIP:ed object wherein the HIP:ed object is a tube, the method comprising the steps of:

a) providing a form defining a shape of a billet or a hollow or a bar;
b) providing a powder as defined in claim 10;
c) filling at least a portion of said form with said powder;
d) subjecting said form to hot isostatic pressing at a temperature, at an isostatic pressure, and for a predetermined time so that particles of the powder bond metallurgically to each other; and
e) hot working the obtained billet, hollow or bar.

12. A method of manufacturing a HIP:ed object wherein the HIP:ed object is a tube, the method comprising the steps of:

a) providing a form defining a shape of a billet or a hollow or a bar;
b) providing a powder as defined in claim 1;
c) filling at least a portion of said form with said powder;
d) subjecting said form to hot isostatic pressing at a temperature, at an isostatic pressure, and for a predetermined time so that particles of the powder bond metallurgically to each other; and
e) hot working the obtained billet, hollow or bar.

13. The method according to claim 12, wherein the hot working process is extrusion.

14. The method according to claim 12, wherein the method comprises a cold working step which is performed after the hot working step.

15. The method according to claim 14, wherein the method optionally comprises a heat treatment step which is performed either after the hot working step or after the cold working step.

16. The method according to claim 15, wherein the heat treatment process is solution annealing.

17. A HIP:ed object, comprising an austenitic alloy having the following composition in weight %:

C less than or equal to 0.03;
Si 0.1 to 0.5;
Mn 0.1 to 2.0;
P less than or equal to 0.01;
S less than or equal to 0.05;
Cr 26.7 to 28;
Ni 35 to 36;
Mo 6.1 to 6.7;
N 0.32 to 0.60;
Cu less than or equal to 0.4;
balance Fe and unavoidable impurities.

18. The HIP:ed object according to claim 17, wherein the content of Si is between 0.1 to 0.3 weight %.

19. The HIP:ed object according to claim 17, wherein the content of Mn 0.1 to 1.1 weight %.

20. The HIP:ed object according to claim 17, wherein the content of Ni is from 35.3 to 36 weight %.

21. The HIP:ed object according to claim 17, wherein the content of Mo is from 6.4 to 6.6 weight %.

22. The HIP:ed object according to claim 17, wherein the content of N is of from 0.35 to 0.60 weight %.

23. The HIP:ed object according to claim 17, wherein said object comprises less than or equal to 200 ppm O.

24. The HIP:ed object according to claim 17, wherein the HIP:ed object is a tube.

25. A welded tube, comprising two or more tubes according to claim 24, wherein the two or more tubes are joined by welding.

26. An umbilical, comprising a plurality of tubes according to claim 24.

27. A HIP:ed object according to claim 17, comprising an austenitic alloy having the following composition in weight %:

C less than or equal to 0.03;
Si 0.1 to 0.3;
Mn 0.1 to 0.5;
P less than or equal to 0.04;
S less than or equal to 0.05;
Cr 26.7 to 27.8;
Ni 35.3 to 36;
Mo 6.4 to 6.7;
N 0.35 to 0.60;
Cu less than or equal to 0.4;
O less than or equal to 200 ppm;
balance Fe and unavoidable impurities.

28. A method of manufacturing a HIP:ed object according to claim 17, comprising the steps of:

a) providing a form defining at least a portion of the shape of said object;
b) providing a powder comprising an austenitic alloy having the following composition in weight %:
C less than or equal to 0.03;
Si 0.1 to 0.5;
Mn 0.1 to 2.0;
P less than or equal to 0.04;
S less than or equal to 0.05;
Cr 26.7 to 28;
Ni 35 to 36;
Mo 6.1 to 6.7;
N 0.32 to 0.60;
Cu less than or equal to 0.4;
balance Fe and unavoidable impurities;
c) filling at least a portion of said form with said powder;
d) subjecting said form to hot isostatic pressing at a temperature, at an isostatic pressure, and for a time so that particles of the powder bond metallurgically to each other.

29. The method according to claim 28, wherein the obtained HIP:ed object is heat treated.

30. The method according to claim 28, wherein the obtained HIP:ed object is hot worked.

* * * * *